US007921473B1

(12) United States Patent
Winters

(10) Patent No.: US 7,921,473 B1
(45) Date of Patent: Apr. 12, 2011

(54) HEAD COOLING APPARATUS

(76) Inventor: Tyler D. Winters, Greencastle, IN (US)

( * ) Notice: Subject to any disclaimer, the term of this patent is extended or adjusted under 35 U.S.C. 154(b) by 359 days.

(21) Appl. No.: 12/204,606

(22) Filed: Sep. 4, 2008

(51) Int. Cl.

| | |
|---|---|
| ***A42C 5/04*** | (2006.01) |
| ***A42B 1/06*** | (2006.01) |
| ***A42B 1/00*** | (2006.01) |
| ***A42B 1/24*** | (2006.01) |
| ***A61F 9/00*** | (2006.01) |
| ***A61F 9/06*** | (2006.01) |

(52) U.S. Cl. ..... 2/171.3; 2/410; 2/7; 2/8.1; 2/8.6; 2/209.13

(58) Field of Classification Search ..... 2/410, 5, 2/6.1, 6.2, 6.6, 7, 8.1, 413, 424, 425, 171, 2/171.1, 171.2, 171.3, 209.13, 905, 906, 2/909, 918, DIG. 1, 10; D2/865, 866
See application file for complete search history.

(56) References Cited

U.S. PATENT DOCUMENTS

| | | | | | |
|---|---|---|---|---|---|
| 432,728 | A | * | 7/1890 | Eliel | 2/171.3 |
| 3,353,191 | A | * | 11/1967 | Dahly | 2/171.3 |
| 3,391,407 | A | * | 7/1968 | Waters | 2/171.3 |
| 3,548,415 | A | | 12/1970 | Waters | |
| 3,818,600 | A | * | 6/1974 | Fischer | 34/99 |
| 3,881,198 | A | * | 5/1975 | Waters | 2/171.3 |
| 4,483,021 | A | * | 11/1984 | McCall | 2/7 |
| 4,484,363 | A | * | 11/1984 | Varanese | 2/209.13 |
| 4,744,106 | A | * | 5/1988 | Wang | 2/7 |
| 4,893,356 | A | | 1/1990 | Waters | |
| 5,113,853 | A | * | 5/1992 | Dickey | 128/200.28 |
| 5,146,765 | A | * | 9/1992 | Waters | 62/259.3 |
| 5,197,292 | A | * | 3/1993 | McPherson | 62/56 |
| 5,469,579 | A | | 11/1995 | Tremblay et al. | |
| 5,561,862 | A | | 10/1996 | Flores, Sr. | |
| 5,715,533 | A | | 2/1998 | Stein | |
| 6,027,137 | A | * | 2/2000 | Rura | 280/650 |
| 6,032,291 | A | | 3/2000 | Asenguah et al. | |
| 6,115,846 | A | * | 9/2000 | Truesdale | 2/209.13 |
| 6,122,773 | A | | 9/2000 | Katz | |
| 6,228,041 | B1 | * | 5/2001 | Ameer | 601/58 |
| 6,516,624 | B1 | * | 2/2003 | Ichigaya | 62/259.3 |
| 6,681,590 | B1 | * | 1/2004 | Jones | 62/259.3 |
| 6,760,925 | B1 | | 7/2004 | Maxwell | |
| 6,792,624 | B2 | * | 9/2004 | Simmons | 2/209.13 |
| 7,357,135 | B2 | * | 4/2008 | Cunningham et al. | 128/201.22 |
| 7,823,586 | B2 | * | 11/2010 | Glazman | 128/201.25 |
| 2004/0074250 | A1 | * | 4/2004 | Junkins | 62/259.3 |
| 2005/0108807 | A1 | * | 5/2005 | Ahn et al. | 2/171.3 |
| 2006/0101556 | A1 | * | 5/2006 | Goldsborough | 2/171.3 |
| 2007/0000277 | A1 | * | 1/2007 | Bratcher | 62/420 |
| 2008/0295220 | A1 | * | 12/2008 | Webb | 2/171.3 |
| 2010/0017941 | A1 | * | 1/2010 | Taylor | 2/171.3 |

* cited by examiner

*Primary Examiner* — Gary L Welch
*Assistant Examiner* — Jane S Yoon
(74) *Attorney, Agent, or Firm* — Crossley Patent Law; Mark A. Crossley

(57) ABSTRACT

The head cooling apparatus is housed in a case removably fitted within an existing hat crown of a hat, without structural modification to the hat. The case has a plurality of air vents including an intake and a trio of vents which direct air across a hat wearer's head. The fan within the case is adjacent to the intake. The non-evaporative refreezable cooling cartridge is removably fitted within the case. The switched power source within the case is in communication with the fan and a power source. The fan forces air into the intake, across the cooling cartridge and out the vents toward a wearer's head.

1 Claim, 3 Drawing Sheets

HEAD COOLING APPARATUS

BACKGROUND OF THE INVENTION

Under high heat conditions people are more likely to suffer heat injuries. Even if an individual does not suffer heat prostration, heat stroke, or other more serious heat related injuries, various intermediary problems are encountered. Among those problems are loss of concentration, irritability, loss of performance, and discomfort. As the head is a major source of heat loss, covering the head sometimes detracts from cooling. Even if a hat, in conditions such as direct sun exposure, provides insulation against direct sun rays, heat problems can certainly still exist for a wearer. When considering means for alleviating heat build up and increasing heat release from a hat wearer, several factors should be considered. For one, a properly designed device cannot rely on evaporation. This is true for more than one reason. Evaporation is best experienced in a dry climate, something quite often not possible. And, evaporation requires a reservoir of liquid, an inconvenience at best when considering a hat of any sort.

Also, any evaporation which drips water on a hat wearer's head can be dangerous in some work environments, such as electrical work to name one. A properly designed head cooling apparatus which is worn directly on the head is virtually impossible to incorporate effectively into a hat which also fits the user's head. Additionally, while airflow certainly assists in cooling a hat wearer's head, airflow itself is often insufficient. And, a very key concern is that a head cooling apparatus can be fitted to an existing hat without hat modification. The present apparatus provides a head cooling apparatus which removably fits within a hard hat or the like, or any hat which has sufficient space between a wearer's head and the hat, without modification, and uses both airflow and a cooling medium to cool a wearer's head.

FIELD OF THE INVENTION

The head cooling apparatus relates to hats, such as hard hats or any other hat with space between a wearer's head and the hat, and more especially to a head cooling apparatus which is removably fitted to the interior of the hat crown and provides cooling to the head of the wearer.

SUMMARY OF THE INVENTION

The general purpose of the head cooling apparatus, described subsequently in greater detail, is to provide a head cooling apparatus which has many novel features that result in an improved head cooling apparatus which is not anticipated, rendered obvious, suggested, or even implied by prior art, either alone or in combination thereof.

To attain this, the head cooling apparatus removably fits within a hat, such as a hard hat or the like. Any hat which has sufficient space between a wearer's head and the hat can be fitted with the apparatus. The apparatus uses both airflow and a cooling medium to cool a wearer's head. Ideally, the cooling medium is a refreezable product, which is provided with the apparatus. The cooling cartridges supplied are flexible when in the liquid state, then frozen and removably fitted to the interior of the case, and affixed with the hook and loop within the case and on the cartridge. Cooling cartridges provide for virtually endless refreezing. Air is drawn into the case via the fan, which can be many different types of fans. Various fans used in computer cooling arts are used. The ideally employed fan is the squirrel cage fan illustrated. The fan, when switched on, moves air across the cooling cartridge and out of the vents directed around a hat wearer's head, thereby cooling the wearer without relying upon evaporation of some medium, such as water for example. The apparatus is therefore effective in any environment, regardless of humidity. The apparatus is lightweight. All components of the apparatus are easily replaceable, as is the entire apparatus.

Thus has been broadly outlined the more important features of the improved head cooling apparatus so that the detailed description thereof that follows may be better understood and in order that the present contribution to the art may be better appreciated.

An object of the head cooling apparatus is to cool the head of a hat wearer.

Another object of the head cooling apparatus is to removably fit an existing hat with no structural modifications to the hat.

A further object of the head cooling apparatus is to provide cooling without the need for evaporation of a cooling medium.

An added object of the head cooling apparatus is to provide cooling without liquid flow.

And, an object of the head cooling apparatus is to provide cooling without a cooling element in contact with a user's head.

These together with additional objects, features and advantages of the improved head cooling apparatus will be readily apparent to those of ordinary skill in the art upon reading the following detailed description of presently preferred, but nonetheless illustrative, embodiments of the improved head cooling apparatus when taken in conjunction with the accompanying drawings.

In this respect, before explaining the current embodiments of the improved head cooling apparatus in detail, it is to be understood that the head cooling apparatus is not limited in its application to the details of construction and arrangements of the components set forth in the following description or illustration.

Those skilled in the art will appreciate that the concept of this disclosure may be readily utilized as a basis for the design of other structures, methods, and systems for carrying out the several purposes of the improved head cooling apparatus. It is therefore important that the claims be regarded as including such equivalent constructions insofar as they do not depart from the spirit and scope of the head cooling apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the head cooling apparatus generally designated by the reference number 10 will be described.

Figure 4:
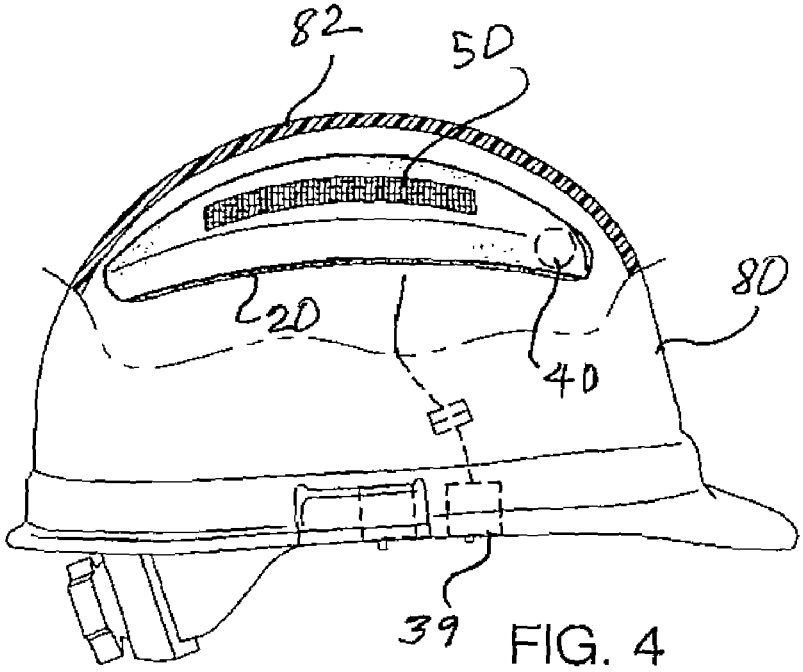
FIG. 4 is a lateral partial cross sectional view of a hat with the apparatus installed.
Figure 5:
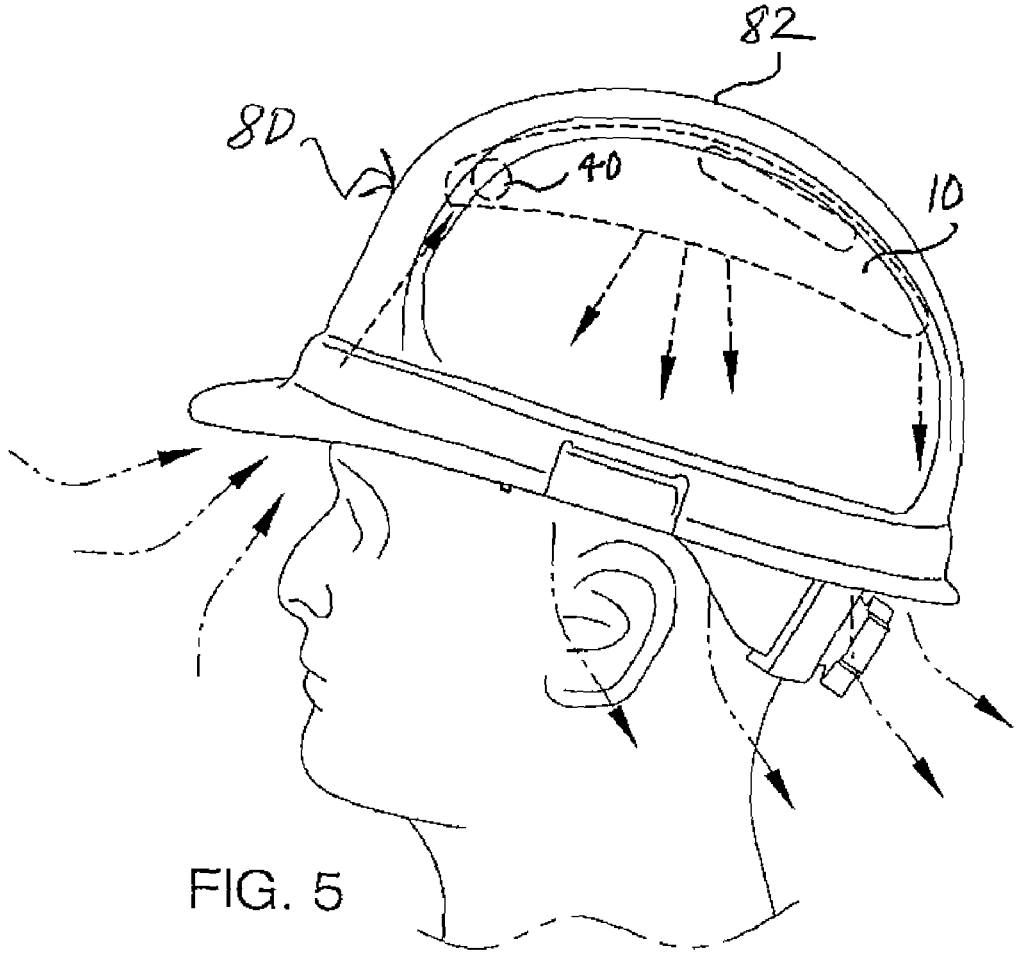
FIG. 5 is a lateral view of the installed apparatus, illustrating air flow.

Referring to FIGS. 4 and 5, the head cooling apparatus 10 removably fits within the crown 82 of an existing hat 80. It is uniquely important to note that the apparatus 10 requires no structural modification to the existing hat 80. Hook and loop 50 is affixed to the interior of the crown 82 via glue or other appropriate means. The hook and loop 50 of the apparatus 10 case 20 is then removably affixed to the crown 82 interior. Air is drawn by the fan 40 into the case 20 and expelled, after cooling around the head of the wearer, thereby cooling the wearer.

Figure 1:
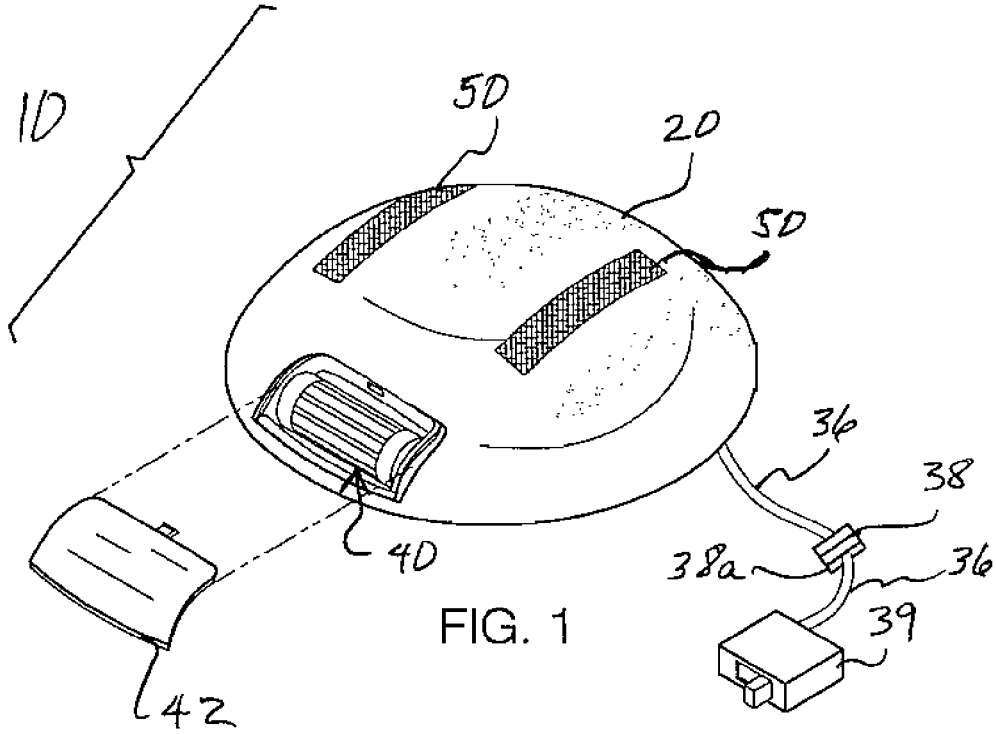
FIG. 1 is a top perspective view, access panel removed.
Figure 3:
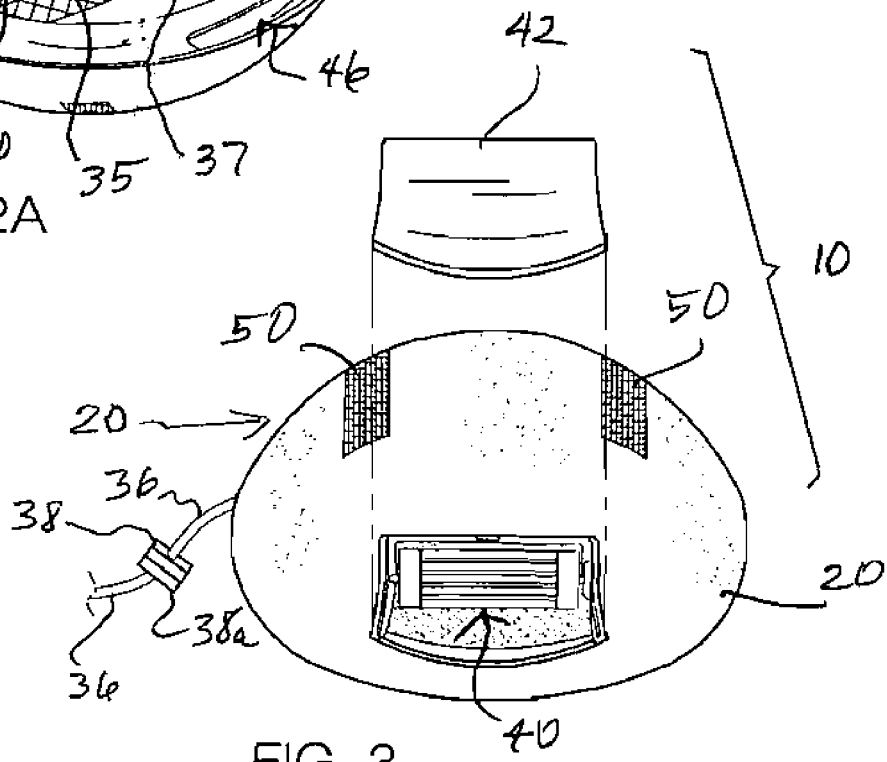
FIG. 3 is a top frontal perspective view.

Referring to FIGS. 1 and 3, the case 20 exterior provides the access panel 42 for accessing the fan 40 within. While the apparatus 10 is not limited to one fan type choice, the squirrel cage fan 40 illustrated is ideal for airflow volume and efficiency. The switch 39 provides on/off control for the fan 40. The switch 39 communicates with the battery 37 within the case 20 via the second connection 38*a*. The second connection 38*a* selectively connects to the first connection 38.

Figure 2:
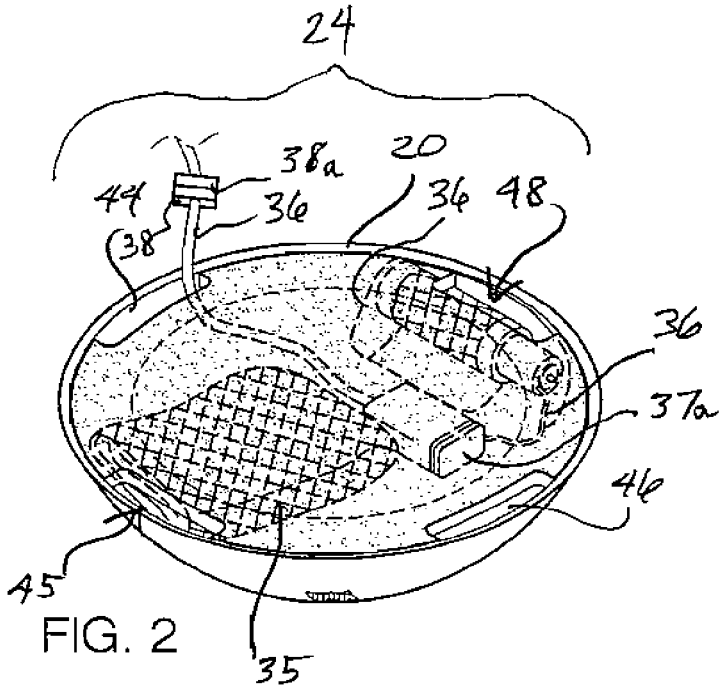
FIG. 2 is a bottom perspective view.
Figure 2A:
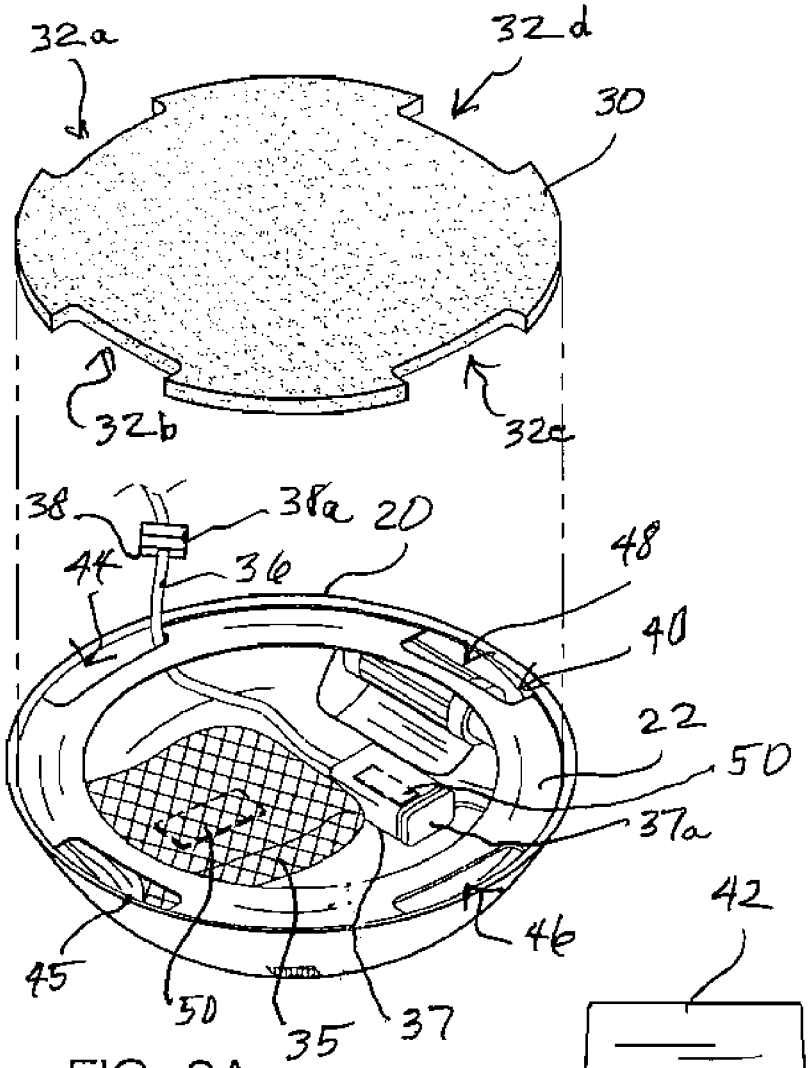
FIG. 2A is a bottom perspective view, breathable panel removed.

Referring to FIGS. 2 and 2A, the apparatus 10 further comprises the rim shelf 22 proximal to the circumference 24 of the case 20. The plurality of vents is disposed within the rim shelf 22. Each vent is approximately ninety degrees apart. The vents are comprised of the first vent 44, the second vent 45, the third vent 46, and the intake 48. The intake 48 provides for the fan's 40 draw into the case 20. The spaced apart hook and loop 50 is disposed on the exterior of the case 20. The access panel 42 in the exterior of the case 20 provides fan 40 access so that fan 40 replacement, if needed, is provided. The sealed cooling cartridge 35 is removably disposed within the case 20. Air flows past the cooling cartridge 35 prior to dissipation to the wearer's head via the vents. The cooling cartridge 35 is optionally comprised of more than one substance, even water. The cooling cartridge 35 is sealed. An ideal substance is a flexible-when-thawed item such as Blue Ice™ which is frozen, then inserted and removably held within the crown's 82 interior via hook and loop 50. The cooling cartridge 35 is instantly renewable, and more than one is provided with the apparatus 10, giving a wearer the option of repeated renewal as cartridges 35 thaw. The cooling cartridge 35 does not leak moisture; however when condensation occurs, especially in humid climates, the breathable panel 30 catches any condensation that might drip and provides for evaporation for further head cooling of the wearer, without drip to the wearer's head. The battery 37 is removably disposed within the case 20 via hook and loop 50. The battery cap 37*a* provides instant battery 37 plug and unplug. Wires 36 provide electrical communication between the electrical components of the apparatus 10. Regarding the breathable panel 30, the plurality of cutouts within the panel is comprised of the first cutout 32*a*, the second cutout 32*b*, the third cutout 32*c*, and the fourth cutout 32*d*. The first cutout 32*a* is in alignment with the first vent 44.

The second cutout 32*b* is in alignment with the second vent 45. The third cutout 32*c* is in alignment with the third vent 46. The fourth cutout 32*d* is in alignment with the intake 48.

Referring again to FIGS. 1-3, it is important to note that all components of the apparatus 10 are easily removable and replaceable, negating obsolescence of the apparatus 10 as an entirety via separate components.

With respect to the above description then, it is to be realized that the optimum dimensional relationships for the parts of the head cooling apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the head cooling apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the head cooling apparatus may be used.

Therefore, the foregoing is considered as illustrative only of the principles of the head cooling apparatus. Further, since numerous modifications and changes will readily occur to those skilled in the art, it is not desired to limit the head cooling apparatus to the exact construction and operation shown and described, and accordingly, all suitable modifications and equivalents may be resorted to, falling within the scope of the head cooling apparatus.

What is claimed is:

1. A head cooling apparatus, comprising:

a hollow semicircular case removably fitted within a crown of an existing hat, without structural modification to the hat, the case further comprising:

a rim shelf proximal to a circumference of the case;

a plurality of vents within the rim shelf, each vent approximately ninety degrees apart, the vents comprising a first vent, a second vent, a third vent, and an intake;

at least one hook and loop on an exterior of the case;

an access panel within an exterior of the case;

a squirrel cage fan within the access panel, the fan adjacent to the intake;

a sealed non-evaporative cooling cartridge removably disposed within the case;

a battery removably disposed within the case;

a first connection in communication with the battery;

a switch in communication with the first connection via a second connection, the switch in communication with the fan and the battery;

a breathable panel removably fitted to the rim shelf;

a plurality of cutouts within the panel comprising a first cutout, a second cutout, a third cutout, and a fourth cutout, the first cutout in alignment with the first vent, the second cutout in alignment with the second vent, the third cutout in alignment with the third vent, and the fourth cutout in alignment with the intake, the fan drawing air into the intake, the fan forcing air across the cooling cartridge and out the vents.

* * * * *